US008065755B2

(12) United States Patent
Chen

(10) Patent No.: US 8,065,755 B2
(45) Date of Patent: Nov. 29, 2011

(54) WATER JET INJECTOR FOR SANITARY SELF-CLEANING TOILET SEAT DEVICE

(76) Inventor: David Chen, Shenang Township, Changhua County (TW)

( * ) Notice: Subject to any disclaimer, the term of this patent is extended or adjusted under 35 U.S.C. 154(b) by 284 days.

(21) Appl. No.: 12/430,065

(22) Filed: Apr. 24, 2009

(65) Prior Publication Data

US 2010/0269247 A1 Oct. 28, 2010

(51) Int. Cl.
*A47K 3/20* (2006.01)

(52) U.S. Cl. ..... 4/420.4; 4/443; 4/447

(58) Field of Classification Search ..... 004/420–420.5, 004/443, 448, 662, 661; 74/56, 89.35; 138/157, 138/158
See application file for complete search history.

(56) References Cited

U.S. PATENT DOCUMENTS 4,337,671 A * 7/1982 Ulf ..... 74/424.94
4,704,748 A * 11/1987 Takeda et al. ..... 4/420.4
6,477,720 B2 * 11/2002 Tomita et al. ..... 4/420.4
2005/0246828 A1 * 11/2005 Shirai et al. ..... 4/420.4
2006/0085902 A1 * 4/2006 Lee ..... 4/420.4
2006/0207006 A1 * 9/2006 Koga et al. ..... 4/420.4
2008/0052813 A1 * 3/2008 Kwon et al. ..... 4/420.4
2008/0201836 A1 * 8/2008 Yao ..... 4/420.4
2009/0077733 A1 * 3/2009 Jin ..... 4/448
2010/0162475 A1 * 7/2010 Hashidume et al. ..... 4/233
2011/0072571 A1 * 3/2011 Mochita et al. ..... 4/443
2011/0072572 A1 * 3/2011 Hashimoto et al. ..... 4/443

FOREIGN PATENT DOCUMENTS

WO WO 2007091691 A1 * 8/2007

* cited by examiner

*Primary Examiner* — Brian Glessner
*Assistant Examiner* — Paola Agudelo
(74) *Attorney, Agent, or Firm* — Chun-Ming Shih

(57) ABSTRACT

A water jet injector for a sanitary self-cleaning toilet seat device includes a foothold having a connector to connect with an external duct; a pipe installed at the front edge of the foothold and having two chambers; and two jet pipes each installed in its corresponding chamber and having a nozzle provided at the top edge of the jet pipe with a water outlet. The jet pipes are movable to and fro to clean the contaminated parts of the user's body with the cleaning water jet. Besides, a shade is stretched out of the pipe to cover the top edges of said nozzles so as to prevent the nozzles from being dirted by the soil and the user's body from being wetted by the residual water in the pipes.

17 Claims, 10 Drawing Sheets

WATER JET INJECTOR FOR SANITARY SELF-CLEANING TOILET SEAT DEVICE

BACKGROUND OF THE INVENTION

1. Field of the Invention

The present invention relates to a water jet injector for sanitary self-cleaning toilet seat device, and in particular, to a water jet injector device equipped with an optical sterilization unit for cleaning the injector nozzles after use so as to avoid the residual water in the pipes to contaminate the user's body.

2. Description of the Prior Art

The sanitary self-cleaning toilet seat device is a toilet seat device equipped with a water jet injector to clean the user's body after defecation so as to eliminate the residual soil sticking around the anus, and also prevent the accidental contact of the fingers with the contaminated parts of the body when using the toilet paper to wipe up the soil. Besides, the user might be more comfortable if the cleaning water is warmed instead of cold, and the unhappy feeling will no more exist if the toilet paper is not used.

In the sanitary self-cleaning toilet seat device, the nozzle located under the path of the injection water mixed with the soil after it has cleaned up the contaminated part of the user might also be seriously contaminated. The next user of the toilet seat device will be dirtied by the water jet sprayed from the contaminated nozzle. The nozzle of the sanitary toilet seat device must be cleaned every time after being used, but simply using water is insufficient.

Warm water, however, gives an easy feeling, but the residual water in the water pipe cools down below the body temperature, which makes the next user feel unhappy. For these defects noticeable on the prior art, an improvement is seriously required.

The inventor of the present invention has put in very much effort on this matter for years to studying and improving these defects and come up with a novel water jet injector for sanitary self-cleaning toilet seat device as provided in this invention to eliminate the defects mentioned above.

SUMMARY OF THE INVENTION

It is an object of the present invention to provide a water jet injector for sanitary self cleaning toilet seat device whose nozzles are shaded to avoid causing the user to feel uncomfortable by contacting the preceding cold water jet.

It is another object of the present invention to provide aforesaid water jet injector that is equipped with an optical sterilization unit nearby the nozzles to clean and sterilize the nozzles.

It is still another object of the present invention to provide aforesaid water jet injector that is provided with a self-cleaning water channel to clean the nozzles.

It is one more object of the present invention to provide aforesaid water jet injector that is equipped with a selection value and selection motor to select the source of water so as to effectively making use of water.

To achieve these and other objects mentioned above, the water jet injector essentially comprises a foothold, a pipe and two jet pipes. The foothold is connected to the external duct with a connector. The pipe, which being installed at the front edge of the foothold, is divided into two chambers, and each of the two jet pipes is connected to its chamber respectively. Each jet pipe has a nozzle attached to its front end, and each nozzle has a water outlet near its top edge. The two jet pipes move to and for so as to clean the contaminated parts of the user's body after finishing defecation.

A shade is stretched out of the nozzle top edge to protect the nozzle from being contaminated by the soil, and the user's body from being wetted by the residual water injection from the nozzles so as to secure sanitariness.

Other objects and purposes of the invention will be apparent to persons acquainted with apparatus of this general type upon reading the following specification and inspection of the accompanying drawings.

DETAILED DESCRIPTION OF THE PREFERRED EMBODIMENT

Figure 1:
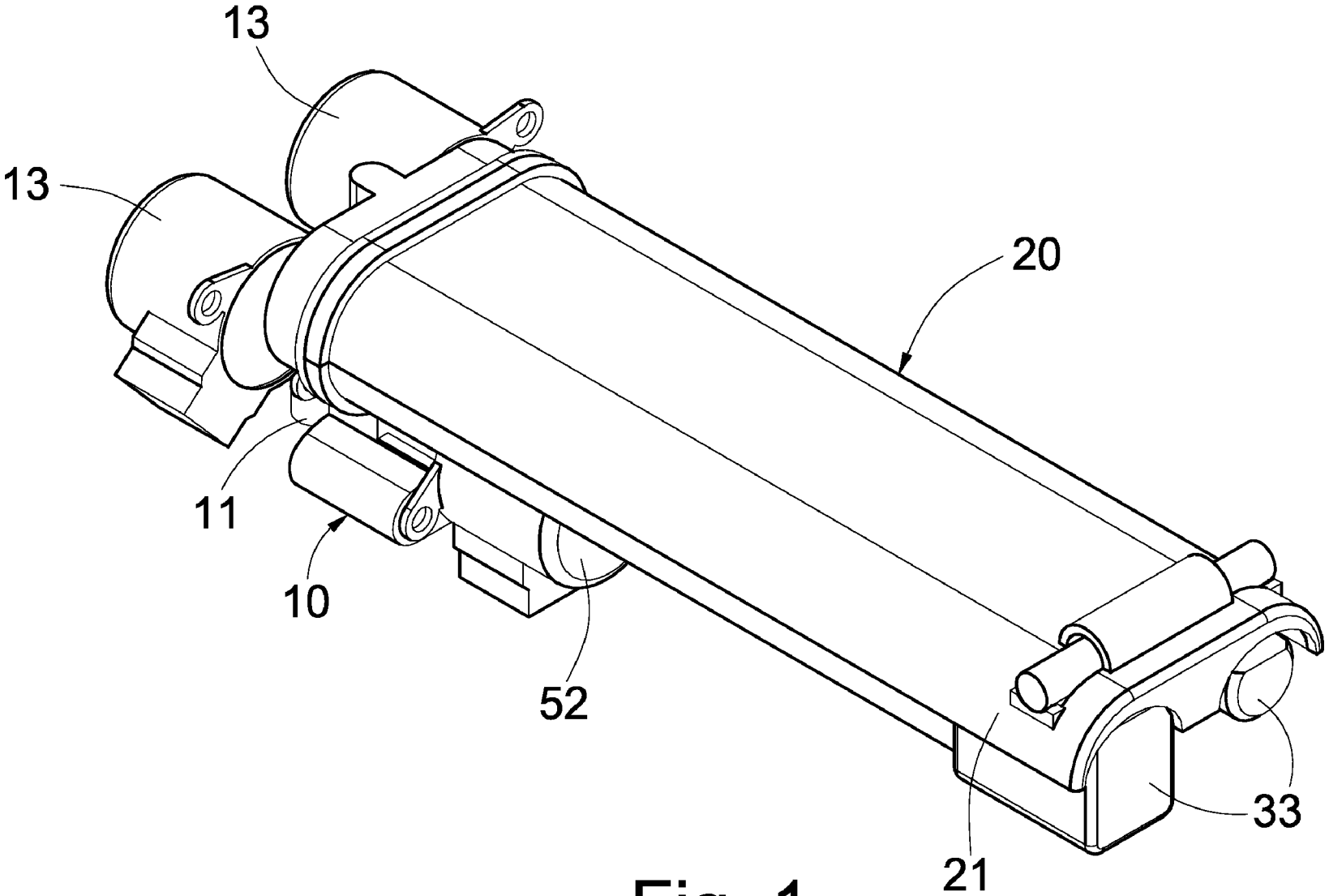
FIG. 1 is a perspective view of the water jet injector in a first embodiment of the present invention.
Figure 2:
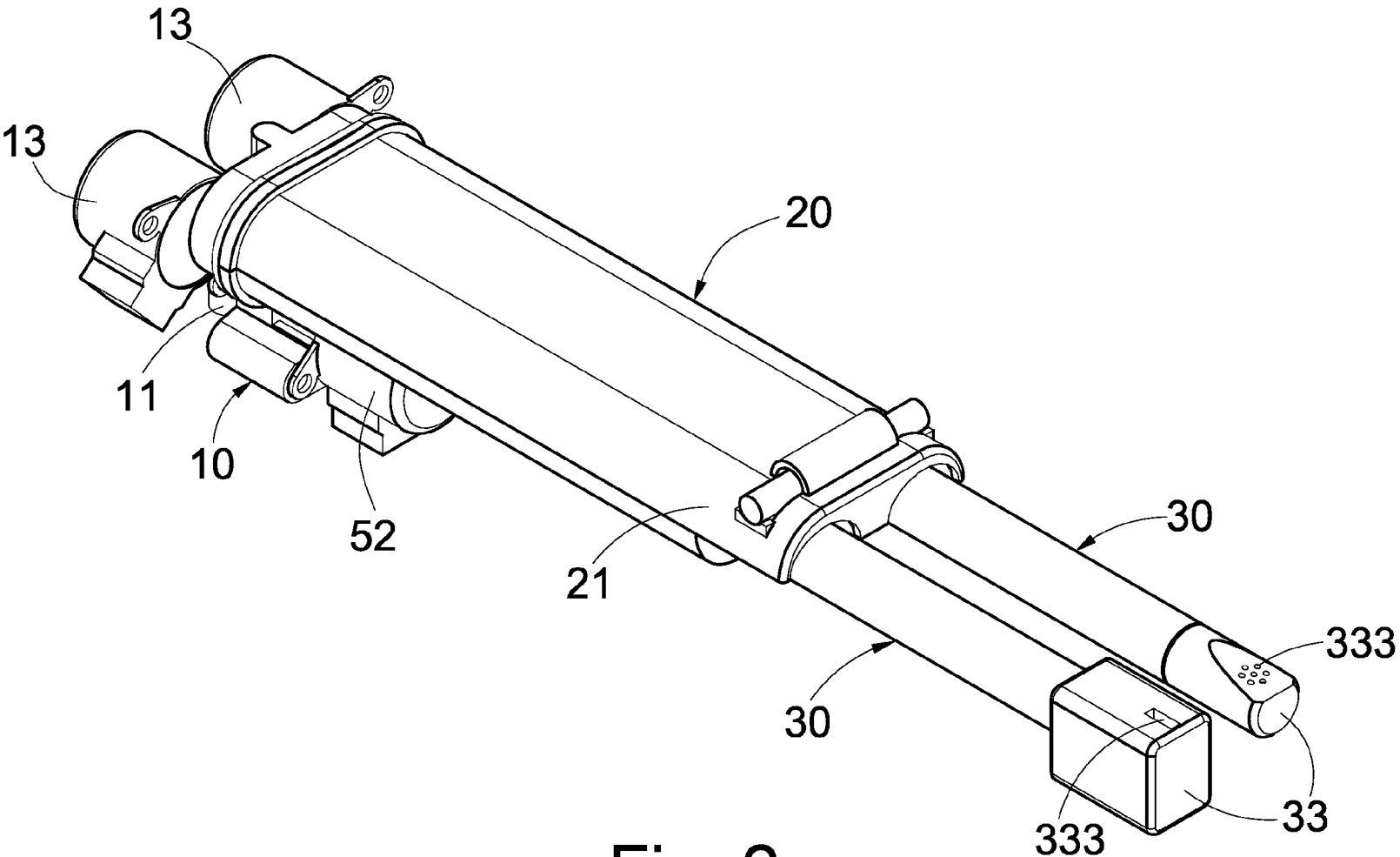
FIG. 2 is a perspective view showing the jet pipes are stretched out in a first embodiment of the present invention.
Figure 3:
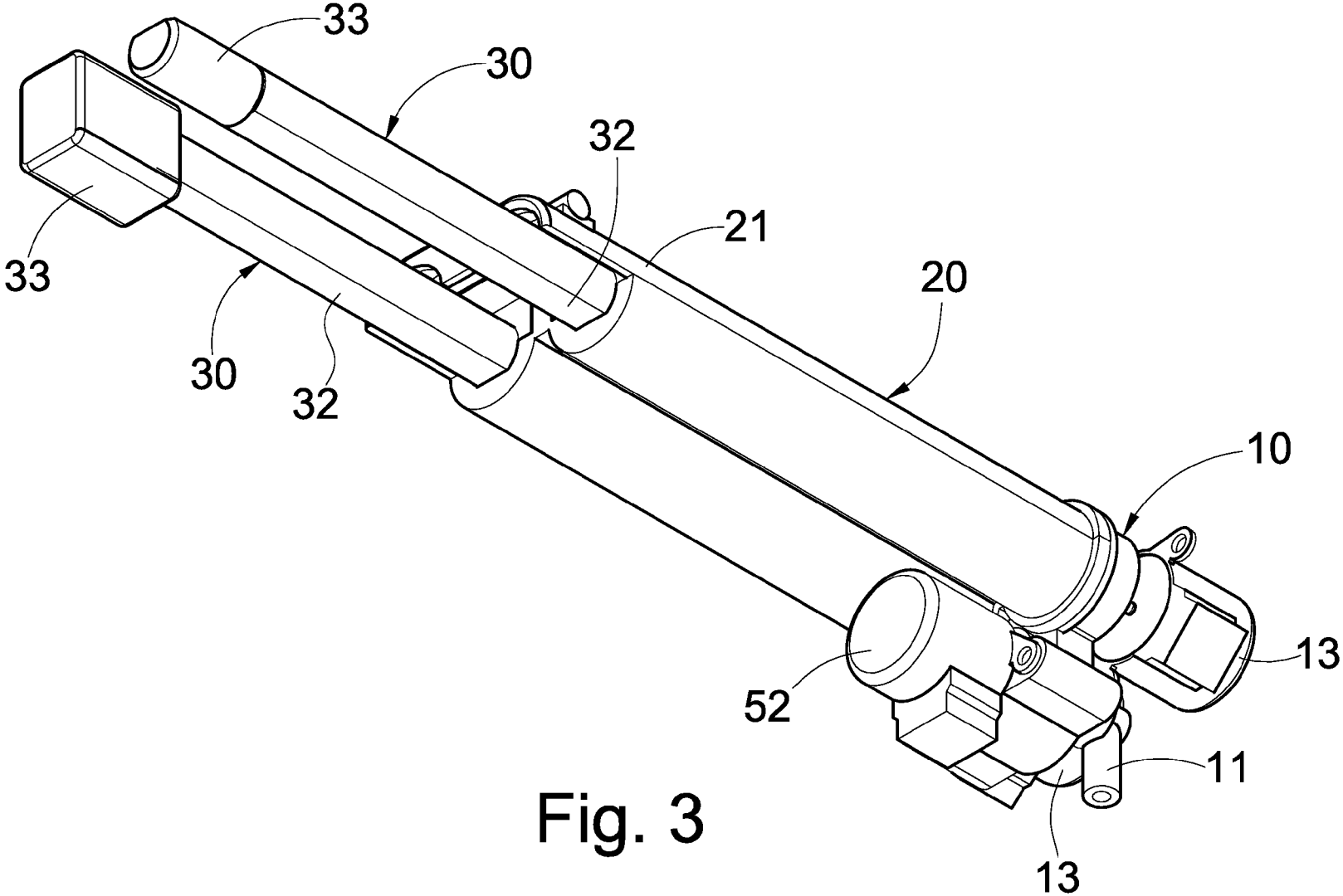
FIG. 3 is a perspective view of the jet pipes from another angle in a first embodiment of the present invention.
Figure 6:
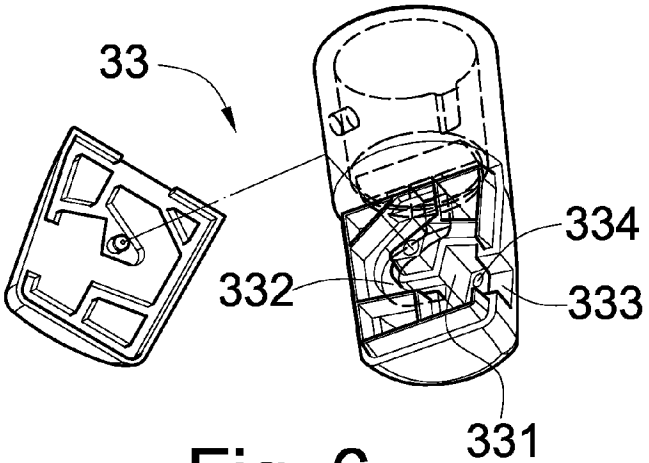
FIG. 6 is a perspective exploded view of the nozzles.
Figure 7:
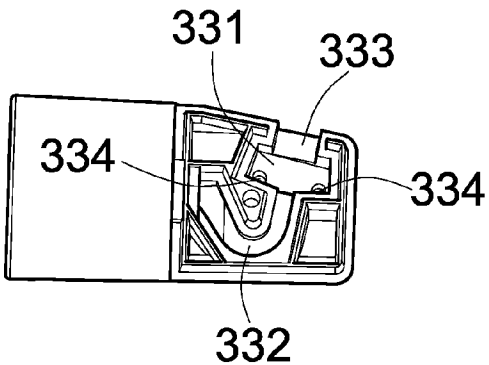
FIG. 7 is a side view of the nozzles.
Figure 4:
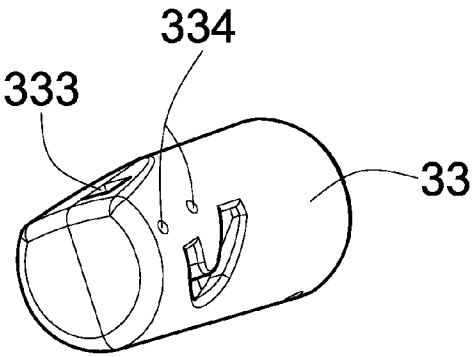
FIG. 4 and FIG. 5 are schematic view of nozzles in another embodiment.
Figure 5:
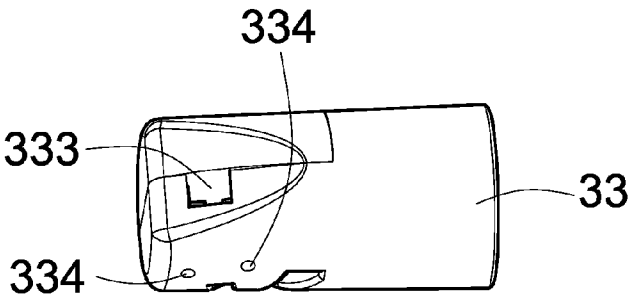

Referring to FIG. 1 through FIG. 3, in this first embodiment, the water jet injector comprises a foothold 10, a pipe 20 and two jet pipes 30, wherein the foothold 10 has a connector 11 to connect with an external duct so as to introduce water into the foothold 10. The pipe 20 is installed at the front edge of the foothold 10, and the jet pipes 30 are able to move to and fro in the axial direction. A nozzle 33 is provide at the front end of each jet pipe 30 with a water outlet 333 formed at the top edge thereof so as to introduce water into the jet pipes 30 and inject it out of the nozzles 33 thereby cleaning the contaminated parts of the user's body. A shade 21 is stretched out of the pipe 20 to cover the top edges of the nozzles 33 so as to improve sanitariness of the toilet seat device and user's conformability.

When the water jet pipes 30 cease to work and stay at the state shown in FIG. 1, the shade 21 protects the nozzles 33 from being contaminated by the soil of the user. The cold residual water in the jet pipes 30 is discharged from the nozzles 33 without contacting the user's body by protection of the shade 21. After expelling the cold residual water from the nozzles 33, the user, who has finished defecation, can move outwards the water jet pipes 30 in the axial direction until the nozzles 33 reach the preset position, the preheated warm water is then successively supplied to the water jet pipes 30 and injected from the nozzles 33 to clean the contaminated parts of the user's body.

Meanwhile, the nozzles 33 may be easily detached from the end of the jet pipes 30 for replacement, and a variety of types can be prepared for selection.

As shown in FIG. 4 to FIG. 7, each nozzle 33 has at least a hole 334 and a mixing chamber 331, a water channel 332 and a water outlet 333, when water flows to mixing chamber 331 via water channel 332, air is imbibed into the mixing chamber 331 from the hole 334. Such that the water and air is mixed in a proportion (the number and the size of the hole 334 can control the mixing ratio), finally, the water jet mixed with air is forcibly injected out of the outlet 333.

Figure 8:
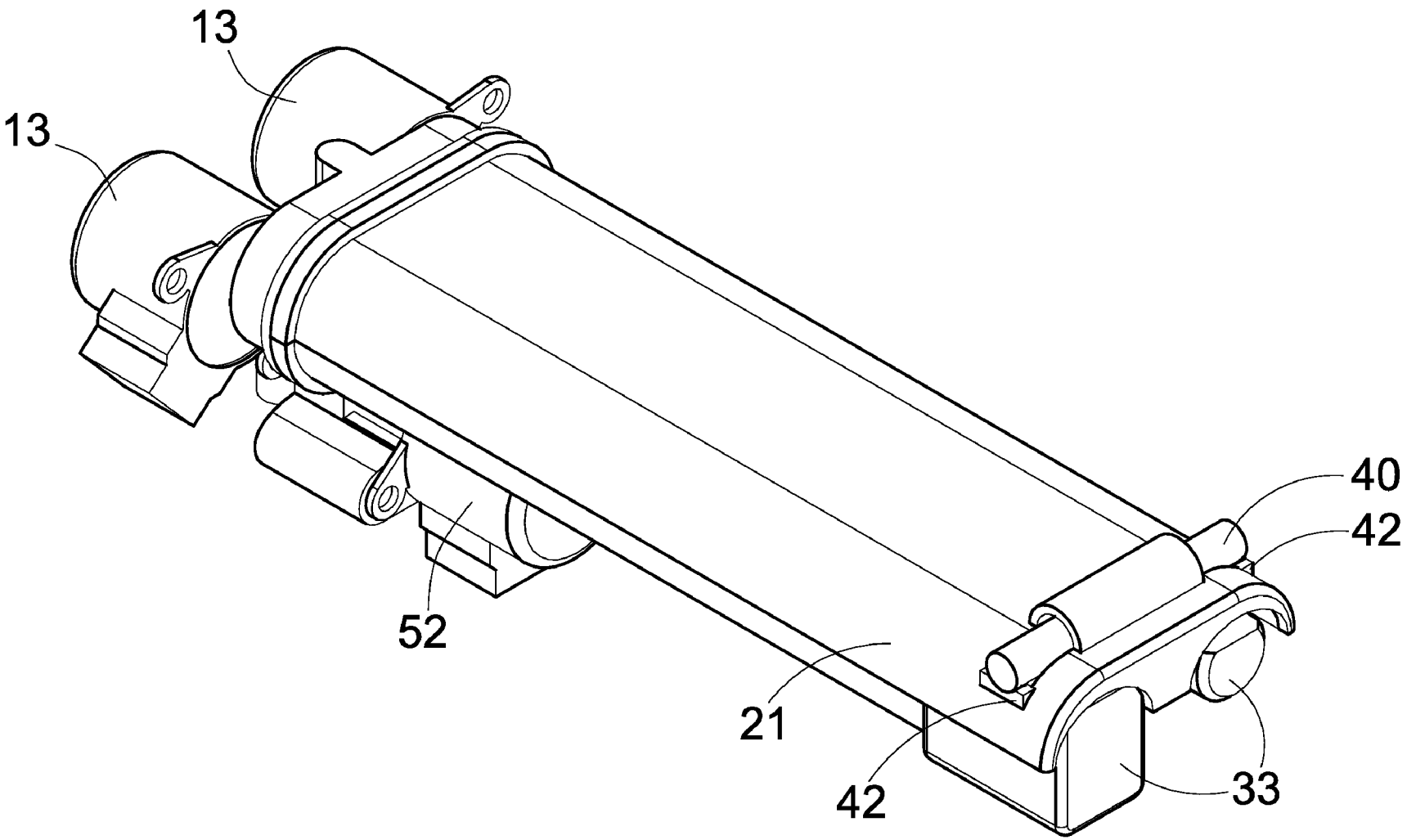
FIG. 8 is a perspective view of a second embodiment.

Referring to FIG. 8, in the second embodiment which being modified from the first one, comprises a sterilization unit 40 in connection with the shade 21 by means of a fitting seat 42 at both ends thereof, and its middle portion faces against the nozzles 33 via shade 21 and settled. The sterilization unit 40 sterilizes and demolishes the harmful germs with bactericidal light thereby maintaining the nozzles 33 sanitarily clean.

Figures 9, 9A:
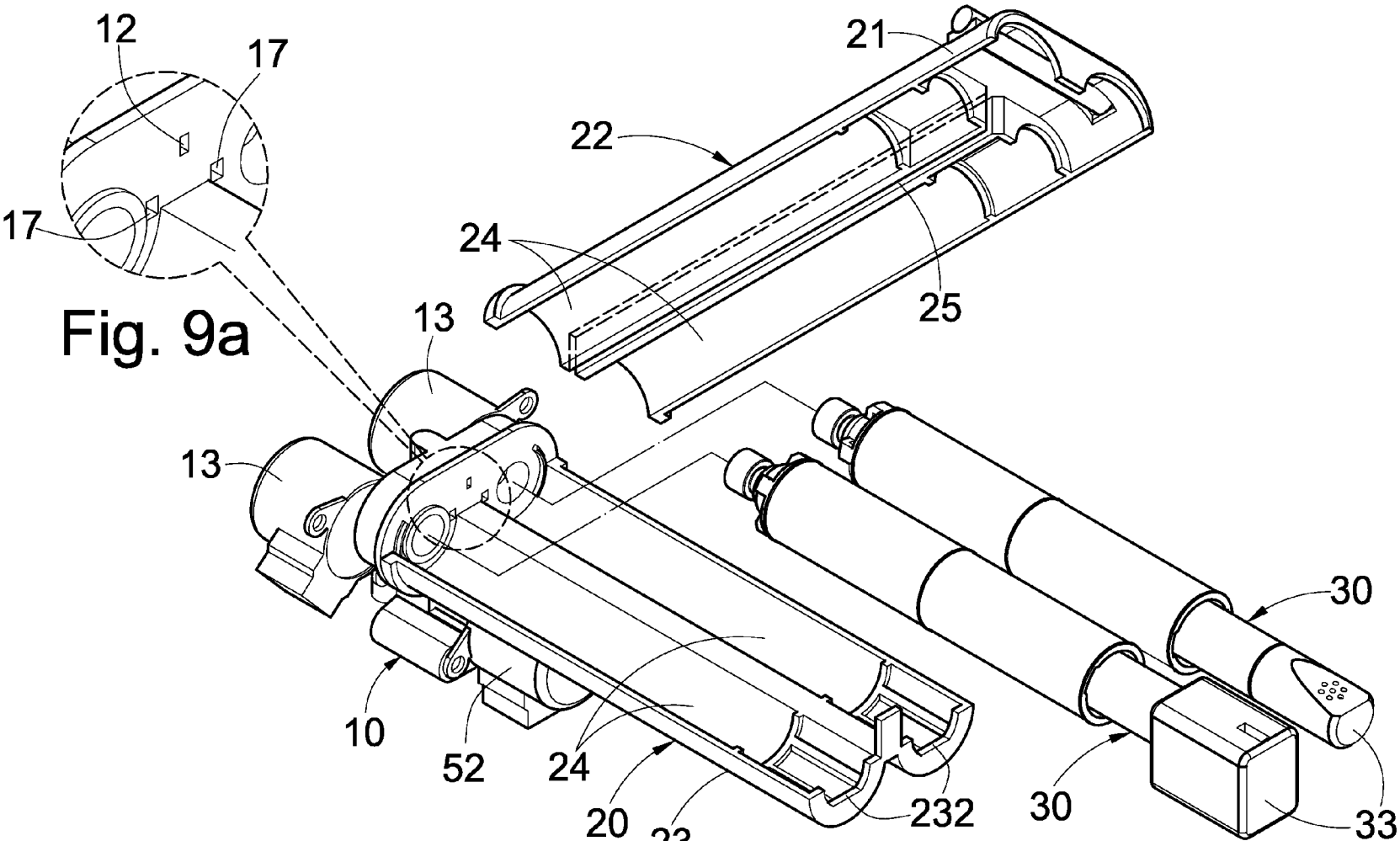
FIG. 9 and FIG. 9*a* are partially exploded perspective view in a third embodiment.

Referring to FIG. 9 and FIG. 9*a*, in the third embodiment which being also modified from the first one comprises a foothold 10, a pipe 20 and two jet pipes 30. The pipe 20 consists of an upper housing 22 and a lower housing 23 both in a tubular shape to be coupled together. The upper housing 22 is extended outwards to form a shade 21. The pipe 20 has two chambers 24 inside and is disposed in parallel so as to hold jet pipes 30 respectively in position. A first self-cleaning water channel 25 is formed between the chambers 24 in the pipe 20 with its one end communicated with the bottom space of the shade 21. A self cleaning water outlet 12 communicated with the first self cleaning water channel 25 is formed on the foothold 10 for transmitting the water to clean the nozzles 33 located at the bottom space of the shade 21 via the first self cleaning water channel 25 before and after cleaning the user's body so as to maintain sanitariness.

Figure 10:
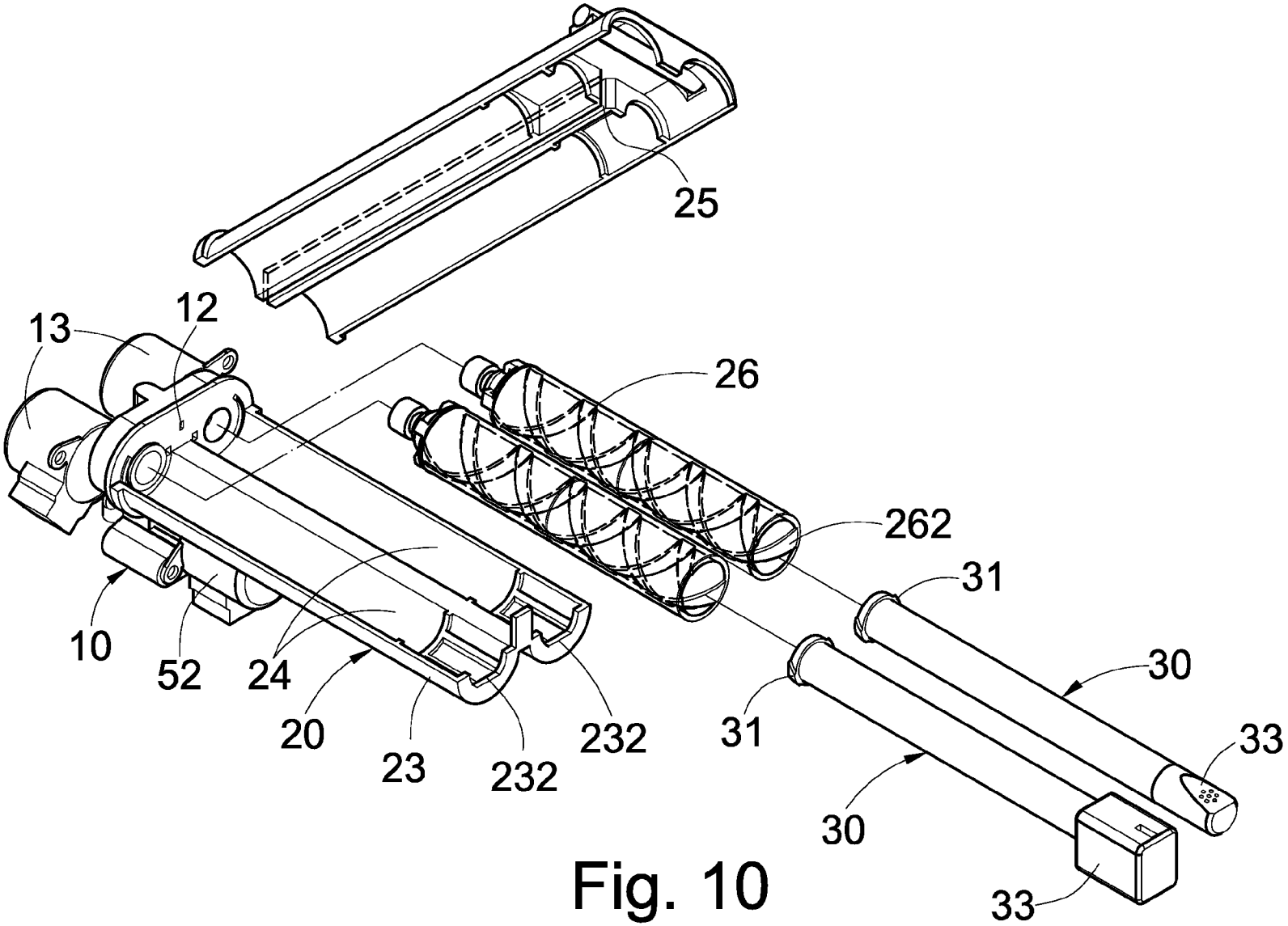
FIG. 10 is a partially exploded perspective view in a fourth embodiment.

Referring to FIG. 10, in a the fourth embodiment which being also modified from the first one, comprises a foothold 10, a pipe 20 and two jet pipes 30. The pipe 20 has two chambers 24 inside which being disposed in parallel. There are two motors 13 installed on the foothold 10. Each chamber 24 is hinged with a guide pipe 26, which is further connected to the shaft of each motor 13 to be driven to rotate and move to and fro. There is formed a helical guide groove 262 along the inner wall of the guide pipe 26. The jet pipe 30 inserts its one end into the guide pipe 26 and snuggly engages with the guide groove 262 with a collar 31 provided for the jet pipe 30. On the end plate of the lower housing 23 of the pipe 20 there is formed a recessed slot 232 having a linearly profiled middle portion, and a planar guide surface 32 is formed at the bottom of each jet pipe 30 corresponding to the recessed slot 232 (see FIG. 3). With this structure, when the guide pipe 26 revolves and displaces to and fro, the linearly profiled portion of recessed slot 232 detains the jet pipes 30 not to revolve with the guide pipe 26 thereby permitting the jet pipes 30 to move only to and fro in the axial direction. With the combination of the guide pipe 26 and the jet pipe 30, when the motor 13 drives the guide tube 26 to revolve and displace to and fro, the collar 31 of the jet pipe 30 helically slides along the guide groove 262 so as to control the displacement of the jet pipe 30 in the axial direction. The user may select any of two motors 13 to remove a specified jet pipe 30 to an intended position to clean the desired portion of the body.

Figure 11:
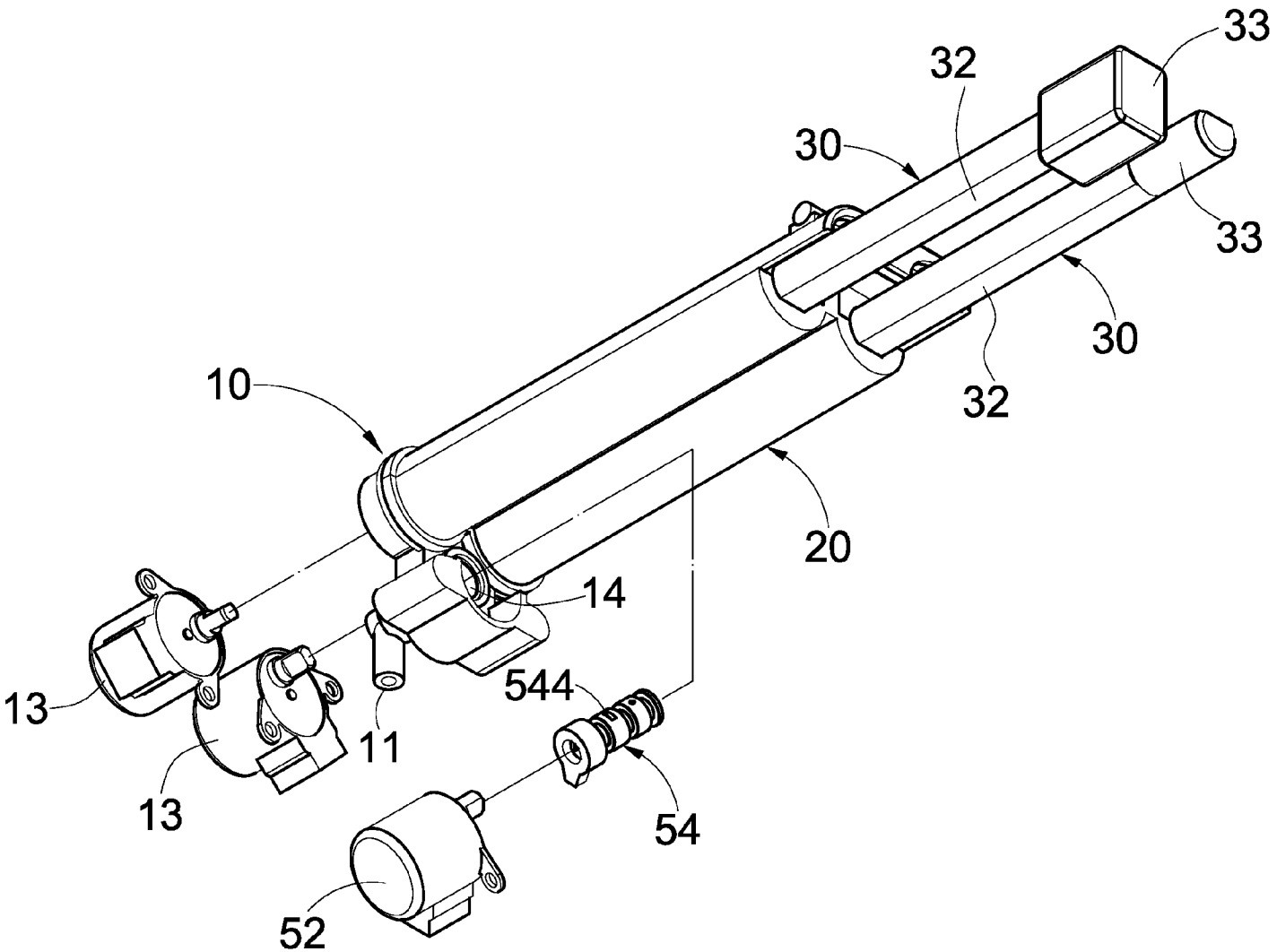
FIG. 11 is a partially exploded perspective view in a fifth embodiment.

Referring to FIG. 11, the fifth embodiment, which being the modification of the first and the third ones, by omitting repeated description, comprises a foothold 10, a pipe 20 and two jet pipes 30. Wherein a selection motor 52 and a selection valve 54 are installed on the foothold 10. The selection valve 54 is hinged to a mounting hole 14 provided on the foothold 10. The selection valve 54 is conjoined with the shaft of the selection motor 54 and driven by the latter to swing to and fro.

Figure 12:
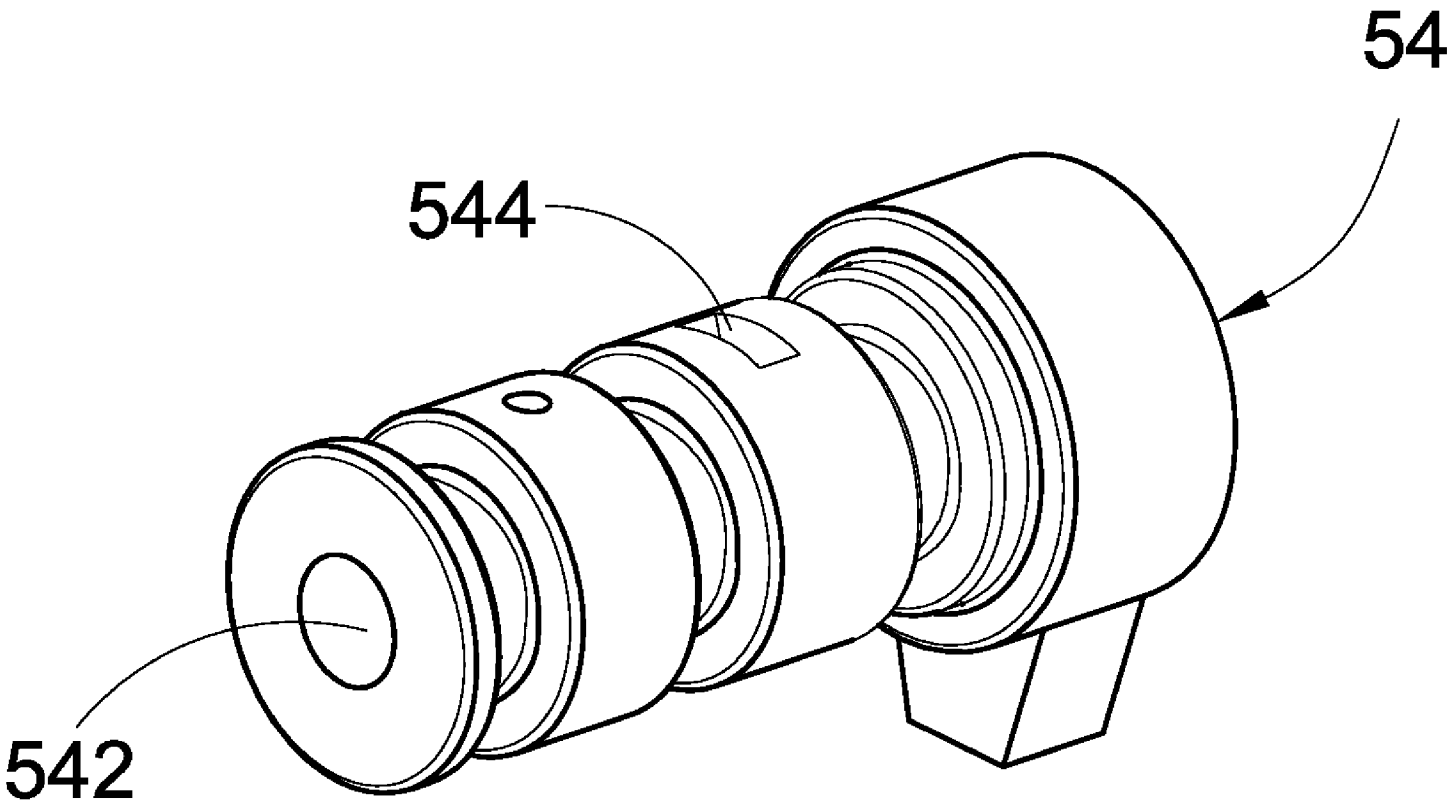
FIG. 12 is a perspective view of the selection valve viewed from another angle in a fifth embodiment.

Referring FIG. 12, there is an interior water channel 542 formed in the axial direction of selection valve 54. On end of the interior water channel 542 is communicated with the connector 11 of the foothold 10 to get supply of water from there. An outlet 544 is formed on the selection valve 54 in its radial direction to communicate with the interior water channel 542 such that the water can flow along the interior water channel 542 to the outlet 544.

Figure 14:
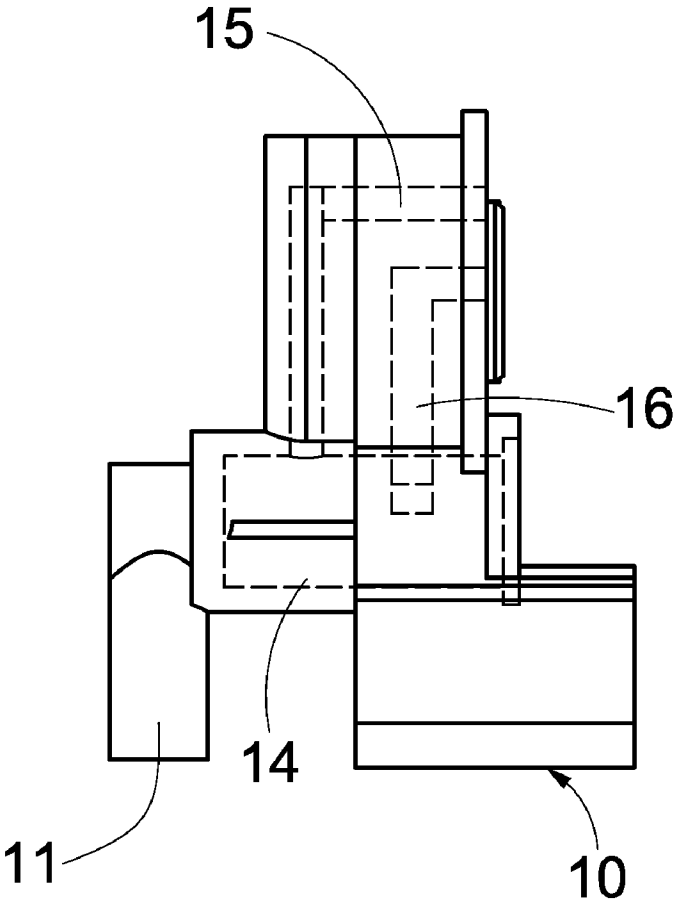
FIG. 14 is a left side view of the foothold in a fifth embodiment of FIG. 11.
Figure 13:
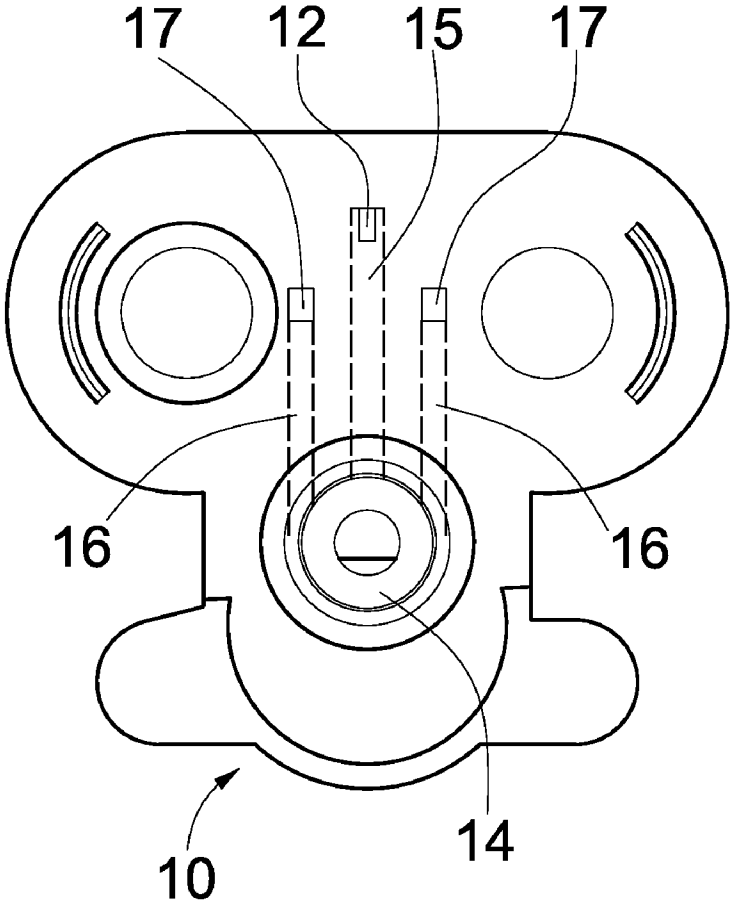
FIG. 13 is a front view of the foothold in a fifth embodiment of FIG. 11.

Referring to FIG. 13 and FIG. 14, there are a second self cleaning water channel 15 and two water transmission channels 16 formed in the foothold 10, and a self cleaning water outlet 12 of the second self cleaning water channel 15 is formed at its one end at the front edge of the foothold 10, and the other end thereof is communicated with the mounting hole 14. One end of each water transmission channel 16 forms a water outlet 17 at the front edge of the foothold 10, and the other end thereof is in communication with the mounting hole 14. Besides, the self cleaning water outlet 12 and the self cleaning water channel (not shown) in the pipe 20 is communicated with each other, and each water outlet 17 is communicated with its corresponding chamber (not shown). With this structure, when the selection valve swings to cause its outlet 544 in communication with the second self-cleaning water channel 15 and the water transmission channel 16, the water can be supplied to both channels 15 and 16. In the fifth embodiment, by driving the selection motor 52 to swing the selective valve 54 for selecting either the second self-cleaning water channel 15 or the jet pipe is to be supplied with water. By so, the supply of water can be effectively controlled resulting in improvement of water resource utilization.

Although the present invention has been disclosed and illustrated with respect to the preferred embodiments thereof, it is to be understood that the invention is not to be so limited and that other changes and modifications can be made within the full-intended scope of the invention as hereinafter claimed.

What is claimed is:

1. A water jet injector for a sanitary toilet seat, comprising:

a foothold having a connector to connect with an external duct;

a pipe installed at a front edge of said foothold and having two chambers; and two jet pipes each installed in a corresponding chamber and having a respective nozzle provided at a top edge of said jet pipe with a water outlet;

wherein said jet pipes are movable to and fro to clean contaminated parts of a user's body with the cleaning water jet; and wherein a shade is extended out of said pipe to cover top edges of said nozzles so as to prevent said nozzles from being dirtied by soil and the user's body from being wetted by residual water in the pipes, wherein said water jet injector further comprises a sterilization unit connected with said shade and facing against said nozzles to sterilize and demolish harmful germs with bactericidal light thereby maintaining said nozzles sanitarily clean, and wherein said sterilization unit is connected to said shade by means of two fitting seat respectively at both ends of said sterilization unit, and settled in a position that a middle portion of said sterilization unit faces against said nozzles via said shade.

2. The water jet injector of claim 1, wherein a self cleaning water channel is formed in said pipe with one end of said self cleaning water channel communicated with a bottom space of said shade, and a self cleaning water outlet communicated with said self cleaning water channel is formed on said foothold for transmitting the water to clean said nozzles before and after cleaning the user's body so as to maintain sanitariness.

3. The water jet injector of claim 2, wherein said chambers are disposed in parallel with each other with the self cleaning water channel interposed therebetween.

4. The water jet injector of claim 1, wherein there are two motors installed on said foothold, each chamber is in communication with a guide pipe which is further connected to the shaft of each motor to be driven to rotate and move to and fro, a helical guide groove is formed along an inner wall of said guide pipe, said jet pipe inserts one end thereof into said guide pipe and snuggly engaged with the guide groove with a collar, with this structure, each guide pipe drives the corresponding jet pipe to move to and fro in an axial direction to clean the contaminated parts of the user's body with water jet.

5. The water jet injector of claim 4, wherein on an end plate of said pipe there is formed a recessed slot having a linearly profiled middle portion, and a planar guide surface is formed at a bottom of each jet pipe corresponding to said recessed slot, with this structure, when said guide pipes revolve and move to and fro, the linearly profiled middle portion of said recessed slot detains said jet pipes not to revolve together with said guide pipes thereby permitting said jet pipes to move only to and fro in the axial direction.

6. The water jet injector of claim 1, wherein each said respective nozzle has at least a hole and a mixing chamber, a water channel and the water outlet, when the water flows to said mixing chamber via the water channel, air is imbibed into said mixing chamber from said hole such that the water and the air is mixed in a proportion, finally the water jet mixed with the air is forcibly injected out of said water outlet to clean the user's body.

7. A water jet injector for a sanitary toilet seat, comprising:

a foothold having a connector to connect with an external duct;

a pipe installed at a front edge of said foothold and having two chambers; and two jet pipes each installed in a corresponding chamber and having a respective nozzle provided at a top edge of said jet pipe with a first water outlet;

wherein said jet pipes are movable to and fro to clean contaminated parts of a user's body with the cleaning water jet;

wherein a shade is extended out of said pipe to cover top edges of said nozzles so as to prevent said nozzles from being dirtied by soil and the user's body from being wetted by residual water in the pipes;

wherein a first self cleaning water channel is formed in said pipe with one end of said self cleaning water channel communicated with a bottom space of said shade, and a self cleaning water outlet communicated with said first self cleaning water channel is formed on said foothold for transmitting the water to clean said nozzles before and after cleaning the user's body so as to maintain sanitariness; and wherein a selection motor and a selection valve are installed on said foothold, said selection valve is in communication to a mounting hole provided on said foothold and conjoined with said selection motor and driven by the latter to swing, wherein an interior water channel is formed in an axial direction of said selection valve and is communicated with the connector of said foothold to get supply of the water, a second water outlet is formed on said selection valve in a radial direction thereof to communicate with said interior water channel such that the water is able to flow along said interior water channel to said second water outlet; a second self cleaning water channel and two water transmission channels are formed in said foothold, and the self cleaning water outlet is formed at one end of said second self cleaning water channel, while the other end of said second self cleaning water channel is communicated with said mounting hole, each water transmission channel forms a third water outlet at one end to communicated with each corresponding chamber, while the other end of said water transmission channel is communicated with said mounting hole at a hole wall, by so said second water outlet is selectively communicated either with said second self cleaning water channel or one of said water transmission channels so as to selectively supply the water to said second self cleaning water channel or one of said jet pipes.

8. A water jet injector for a sanitary toilet seat, comprising:

a foothold having a connector to connect with an external duct;

a pipe installed at a front edge of said foothold and having two chambers; and two jet pipes each installed in a corresponding chamber and having a respective nozzle provided at a top edge of said jet pipe with a first water outlet;

wherein said jet pipes are movable to and fro to clean contaminated parts of a user's body with the cleaning water jet;

wherein a shade is extended out of said pipe to cover top edges of said nozzles so as to prevent said nozzles from being dirtied by soil and the user's body from being wetted by residual water in the pipes; and wherein a selection motor and a selection valve are installed on said foothold, said selection valve is in communication to a mounting hole provided on said foothold and conjoined with said selection motor and driven by the latter to swing; wherein an interior water channel is formed in an axial direction of said selection valve and is communicated with the connector of said foothold to get supply of the water, a second water outlet is formed on said selection valve in a radial direction thereof to communicate with said interior water channel such that the water is able to flow along said interior water channel to said second water outlet; two water transmission channels are formed in said foothold, each of them has a third water outlet at one end to communicate with each chamber, while the other end of said water transmission channel is communicated with said mounting hole at a hole wall, by so said second water outlet is selectively communicated with either one of the two water transmission channels so as to selectively supply water to either one of said jet pipes.

9. A water jet injector for a sanitary toilet seat, comprising:

a foothold having a connector to connect with an external duct, and having two motors;

a pipe installed at a front edge of said foothold and having two chambers each being in communication with a guide pipe which is further connected to a shaft of corresponding motor so as to revolve while moves to and fro, wherein said guide pipe has a helical guide groove formed along an inner wall thereof; and two jet pipes each connected to said guide pipe, and having a collar snuggly engaged with said guide groove;

whereby with this structure each of said guide pipes drives each jet pipe to slide to and fro in an axial direction, and wherein said pipe is a tubular member with an upper housing and a lower housing coupled together, and a shade is extended out of said upper housing.

10. The water jet injector of claim 9, wherein on an end plate of said pipe, there is formed a recessed slot having a linearly profiled middle portion, and a planar guide surface is formed at a bottom of each jet pipe corresponding to said recessed slot, with this structure, when said guide pipes revolve and move to and fro, the linearly profiled middle portion of said recessed slot detains said jet pipes not to revolve together with said guide pipes thereby permitting said jet pipes to move only to and fro in the axial direction.

11. The water jet injector of claim 9, wherein each jet pipe has a respective nozzle provided at a front end thereof with a water outlet formed at a top edge.

12. The water jet injector of claim 9, wherein the shade is extended out of said pipes to cover top edges of said nozzles.

13. The water jet injector of claim 9, wherein said water jet injector further comprises a sterilization unit connected with said shade and facing against said nozzles to sterilize and demolish harmful germs with bactericidal light thereby maintaining said nozzles sanitarily clean.

14. The water jet injector of claim 9, wherein a self cleaning water channel is formed in said pipe with one end of the self cleaning water channel communicated with a bottom space of said shade, and a self cleaning water outlet communicated with said self cleaning water channel is formed on said foothold for transmitting the water to clean said nozzles before and after cleaning the user's body so as to maintain sanitariness.

15. The water jet injector of claim 14, wherein said chambers are disposed in parallel with each other with the self cleaning water channel interposed therebetween.

16. A water jet injector for a sanitary toilet seat, comprising:

a foothold having a connector to connect with an external duct, and having two motors;

a pipe installed at a front edge of said foothold and having two chambers each being in communication with a guide pipe which is further connected to a shaft of corresponding motor so as to revolve while moves to and fro, wherein each said guide pipe has a helical guide groove formed along an inner wall thereof; and two jet pipes each connected to a corresponding guide pipe, and having a collar snuggly engaged with said guide groove;

whereby with this structure each of said guide pipes drives each jet pipe to slide to and fro in an axial direction, and wherein a selection motor and a selection valve are installed on said foothold, said selection valve is in communication to a mounting hole provided on said foothold and conjoined with said selection motor shaft and driven by the latter to swing; wherein an interior water channel is formed in the axial direction of said selection valve and is communicated with the connector of said foothold to get supply of water, a first water outlet is formed on said selection valve in a radial thereof direction to communicate with said interior water channel such that the water is able to flow along said interior water channel to said first water outlet; a self cleaning water channel and two water transmission channels are formed in said foothold, said self cleaning water channel forms a self cleaning water outlet at one end thereof, and the other end is communicated with said mounting hole at a hole wall, each of said water transmission channels forms a second water outlet at one end thereof to communicate with the corresponding chamber, while the other end is communicated with said mounting hole at the hole wall, by so said first water outlet is selectively communicated with said self cleaning water channel or either one of said water transmission channels so as to selectively supply the water to said self cleaning water channel or one of the two jet pipes.

17. A water jet injector for a sanitary self-cleaning toilet seat device, comprising:

a foothold having a connector to connect with an external duct, and having two motors;

a pipe installed at a front edge of said foothold and having two chambers each being in communication with a guide pipe which is further connected to a shaft of corresponding motor so as to revolve while moves to and fro, wherein each said guide pipe has a helical guide groove formed along an inner wall thereof; and two jet pipes each connected to a corresponding guide pipe, and having a collar snuggly engaged with said guide groove;

whereby with this structure each of said guide pipes drives each jet pipe to slide to and fro in an axial direction, and wherein a selection motor and a selection valve are installed on said foothold, said selection valve is in communication to a mounting hole provided on said foothold and conjoined with said selection motor and driven by the latter to swing; wherein an interior water channel is formed in the axial direction of said selection valve and is communicated with the connector of said foothold to get supply of the water, a first outlet is formed on said selection valve in a radial direction thereof to communicate with said interior water channel such that the water is able to flow along said interior water channel to said first water outlet; two water transmission channels are formed in said foothold, each of them has a second water outlet at one end to communicate with each chamber, while the other end of each water transmission channel is communicated with said mounting hole at a hole wall, by so said first water outlet is selectively communicated with either one of the two water transmission channels so as to selectively supply water to either one of said jet pipes.

* * * * *